US011733624B2

(12) United States Patent
Sugawara

(10) Patent No.: US 11,733,624 B2
(45) Date of Patent: Aug. 22, 2023

(54) BELT DEVICE, FIXING DEVICE, AND IMAGE FORMING APPARATUS

(71) Applicant: Yoshiki Sugawara, Tokyo (JP)

(72) Inventor: Yoshiki Sugawara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/496,249

(22) Filed: Oct. 7, 2021

(65) Prior Publication Data

US 2022/0121141 A1 Apr. 21, 2022

(30) Foreign Application Priority Data

Oct. 21, 2020 (JP) ..... 2020-176580
Jul. 6, 2021 (JP) ..... 2021-112288

(51) Int. Cl.
*G03G 15/20* (2006.01)

(52) U.S. Cl.
CPC ..... *G03G 15/2021* (2013.01); *G03G 15/2064* (2013.01)

(58) Field of Classification Search
CPC ..... G03G 15/161; G03G 15/1615; G03G 15/2017; G03G 15/2021; G03G 15/2053; G03G 21/168; G03G 21/1685; G03G 2215/2003; G03G 2215/2016
See application file for complete search history.

(56) References Cited

U.S. PATENT DOCUMENTS

2010/0230248 A1* 9/2010 Kimura ..... G03G 15/2053 198/813
2012/0237260 A1 9/2012 Sengoku et al.
2014/0270873 A1 9/2014 Kato et al.

FOREIGN PATENT DOCUMENTS

JP 2012-018238 1/2012
JP 2012-194472 10/2012
JP 2014-178500 9/2014

* cited by examiner

*Primary Examiner* — Thomas S Giampaolo, II
(74) *Attorney, Agent, or Firm* — Harness, Dickey & Pierce, P.L.C.

(57) ABSTRACT

A belt device includes a belt device main body, a first unit, and a second unit. The first unit includes a belt and a support to support the belt. The first unit is configured to detachably attached to the belt device main body. The second unit includes a tensioner abutting the belt. The second unit is configured to be positioned at an operating position at which the tensioner applies tension to the belt when the first unit is attached to the belt device main body and positioned at a releasing position at which the tensioner releases the tension applied to the belt when the first unit is detached from the belt device main body.

20 Claims, 7 Drawing Sheets

BELT DEVICE, FIXING DEVICE, AND IMAGE FORMING APPARATUS

CROSS-REFERENCE TO RELATED APPLICATIONS

This patent application is based on and claims priority pursuant to 35 U.S.C. § 119 to Japanese Patent Applications No. 2020-176580, filed on Oct. 21, 2020 and No. 2021-112288, filed on Jul. 6, 2021 in the Japan Patent Office, the entire disclosure of which is hereby incorporated by reference herein.

BACKGROUND

Technical Field

Embodiments of the present disclosure generally relate to a belt device, a fixing device, and an image forming apparatus.

Related Art

One type of belt device includes a belt, a plurality of support rollers that support the belt, a contact member contacting the belt, and a pressing mechanism that presses the belt.

SUMMARY

This specification describes an improved belt device that includes a belt device main body, a first unit, and a second unit. The first unit includes a belt and a support to support the belt. The first unit is configured to detachably attached to the belt device main body. The second unit includes a tensioner abutting the belt. The second unit is configured to be positioned at an operating position at which the tensioner applies tension to the belt when the first unit is attached to the belt device main body and positioned at a releasing position at which the tensioner releases the tension applied to the belt when the first unit is detached from the belt device main body.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
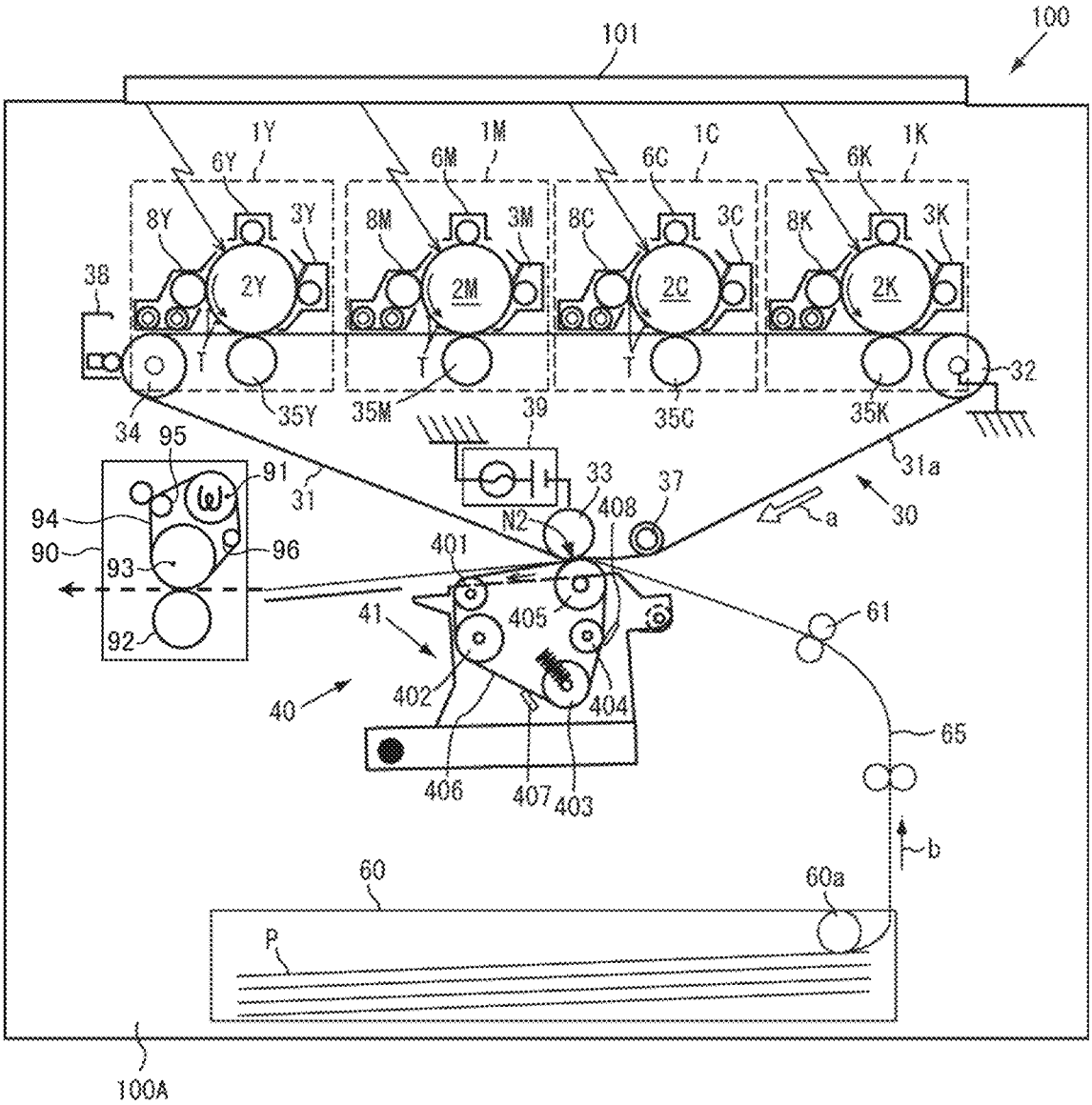
FIG. 1 is a schematic configuration diagram illustrating an electrophotographic color printer (hereinafter referred to as "printer") as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise. Identical reference numerals are assigned to identical components or equivalents and a description of those components is simplified or omitted.

A description is provided of an image forming apparatus according to the present disclosure with reference to drawings. It is to be noted that the present disclosure is not to be considered limited to the following embodiments but can be changed within the range that can be conceived of by those skilled in the art, such as other embodiments, additions, modifications, deletions, and the scope of the present disclosure encompasses any aspect, as long as the aspect achieves the operation and advantageous effect of the present disclosure.

With reference to drawings, the following describes an embodiment of the present disclosure. FIG. 1 is a schematic configuration diagram illustrating an electrophotographic color printer (hereinafter referred to as "printer") as an image forming apparatus according to an embodiment of the present disclosure. The printer 100 includes four image forming units 1Y, 1M, 1C, and 1K to form yellow (Y), magenta (M), cyan (C), and black (K) toner images, a transfer unit 30 serving as an intermediate transfer device, a secondary transfer device 40 including a secondary transfer unit 41, a sheet tray 60 to contain recording media P as conveyed objects, and a fixing device 90 including a heating roller 91 and a pressure roller 92.

The four image forming units 1Y, 1M, 1C, and 1K form an image forming section and use toners of Y, M, C, and K that are different color toners as powder developers. The process units 1K, 1Y, 1M, and 1C have a similar structure except the color of toner. The image forming units 1Y, 1M, 1C, and 1K include drum-shaped photoconductors 2Y, 2M, 2C, and 2K serving as image bearers, photoconductor cleaners 3Y, 3M, 3C, and 3K, dischargers, charging devices 6Y, 6M, 6C, and 6K, developing devices 8Y, 8M, 8C, and 8K, respectively.

The surfaces of the photoconductors 2Y, 2M, 2C, and 2K, uniformly are charged by the charging devices 6Y, 6M, 6C, and 6K, and optically scanned by exposure light such as laser beams emitted from an optical writing device 101 disposed above the image forming units 1Y, 1M, 1C, and 1K to form electrostatic latent images for yellow, magenta, cyan, and black images, respectively. The developing devices 8Y, 8M, 8C, and 8K develop the electrostatic latent images on the photoconductors 2Y, 2M, 2C, and 2K with yellow, magenta, cyan, and black toners, into visible toner images T, respectively. Thus, the toner images T are formed on the photoconductors 2Y, 2M, 2C, and 2K. The toner image T is primarily transferred from each of the photoconductors 2Y, 2M, 2C, and 2K onto a front surface 31*a* of an intermediate transfer belt 31, which is an endless belt.

Below the image forming units 1Y, 1M, 1C, and 1K, the intermediate transfer unit 30, serving as a belt unit and a primary transfer device, is disposed. The transfer unit 30 includes the intermediate transfer belt 31 rotating clockwise in FIG. 1. In the present embodiment, a direction of rotation of the intermediate transfer belt 31 is referred to as a "belt travel direction" indicated by arrow a in FIG. 1.

In addition to the intermediate transfer belt 31, the transfer unit 30 includes a drive roller 32, a secondary-transfer backup roller 33, a cleaning backup roller 34, four primary transfer rollers 35Y, 35M, 35C, and 35K, and a pre-transfer roller 37. The intermediate transfer belt 31 is looped around and stretched taut between the drive roller 32, the secondary-transfer backup roller 33, the cleaning backup roller 34, the four primary transfer rollers 35Y, 35M, 35C, and 35K, and the pre-transfer rollers 37. As a driver such as a drive motor drives and rotates the drive roller 32 clockwise, the intermediate transfer belt 31 rotates clockwise.

Outside and below the loop of the intermediate transfer belt 31, the secondary transfer device 40 including the secondary transfer unit 41 is disposed. The secondary transfer unit 41 includes a secondary transfer belt 406 as a transfer rotator. The secondary transfer belt 406 is entrained around the separation roller 401, a driven roller 402, a tension roller 403 serving as a first blade facing roller and a tension applicator, a second blade facing roller 404, and the secondary transfer roller 405. The secondary transfer unit 41 also includes a plurality of cleaners 407 and 408.

Below the secondary transfer device 40 in FIG. 1, the sheet tray 60 is disposed. The sheet tray 60 is a container to store a bundle of recording media P. In the sheet tray 60, a roller 60*a* contacts an uppermost recording medium P of the bundle of recording media and rotates at a predetermined timing to feed the recording medium P from the sheet tray 60 to a conveyance path 65 toward a secondary transfer nip N2. Then, a registration roller pair 61 forwards the recording medium P in the conveyance path 65 to the secondary transfer nip N2, so that the recording medium P coincides with the toner image on the front surface 31*a* of the intermediate transfer belt 31 in the secondary transfer nip N2.

In the secondary transfer nip N2, the toner image on the front surface 31*a* of the intermediate transfer belt 31 is collectively transferred onto the recording medium P by a secondary transfer electric field and a nip pressure applied thereto, thereby forming a full-color toner image in combination with white color of the recording medium P.

The fixing device 90 is disposed downstream from the secondary transfer nip N2 in a conveyance direction b of the recording medium P. The fixing device 90 is a belt device including a fixing belt 94 as a belt. As illustrated in FIG. 2, the fixing device 90 includes a heating roller 91 as a heating rotator, a fixing roller 93, a support roller 96, and a tension roller 95 serving as a tensioner that are support rollers for the fixing belt 94. The fixing device 90 also includes a pressure roller 92 as a pressing rotator that contacts the fixing roller 93. The fixing belt 94 is sandwiched by the pressure roller 92 and the fixing roller 93. The recording medium P to which the toner image has been transferred is fed to the fixing device 90. The recording medium P is nipped at a fixing nip at which the fixing roller 93 and the pressure roller 92 are in contact with each other via the fixing belt 94. In the fixing device 90, the heating roller 91 includes a heat source therein. Heat of the heat source transfers from the heating roller 91 to the recording medium P via the fixing belt 94 and softens toner in the full-color toner image at the fixing nip. The heat and pressure in the fixing nip fixes the full-color toner image onto the recording medium P. After the toner image is fixed on the recording medium P, the recording medium P is ejected from the fixing device 90, outside the printer 100.

Figure 2A:
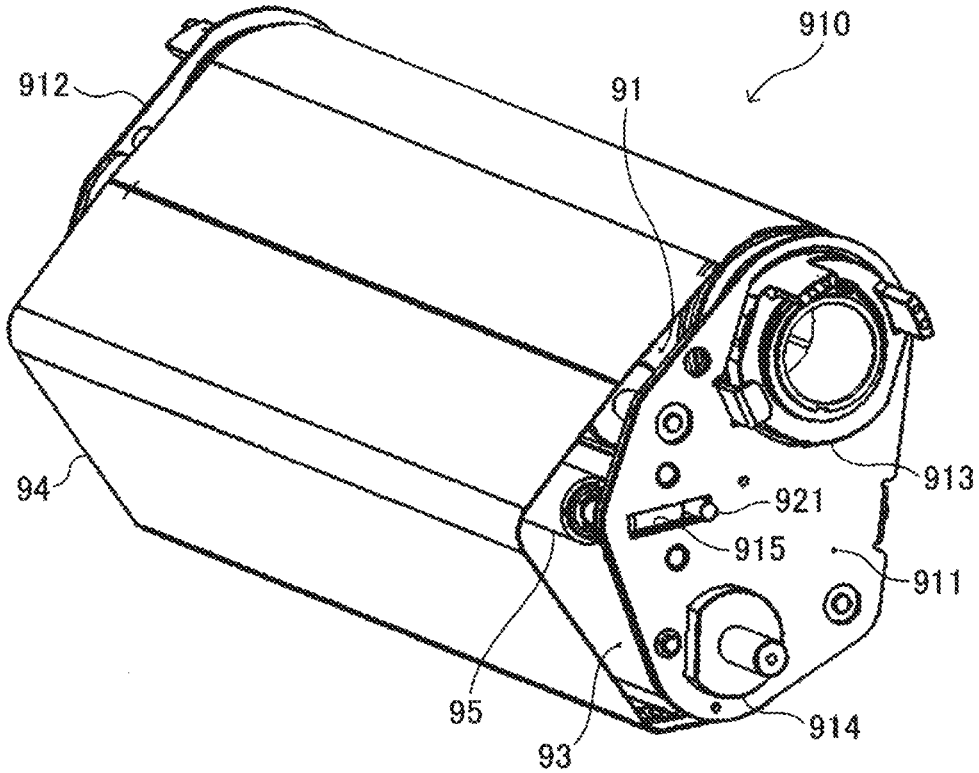
FIG. 2A is a perspective view of a first unit including a fixing belt and rollers supporting the fixing belt.
Figure 2B:
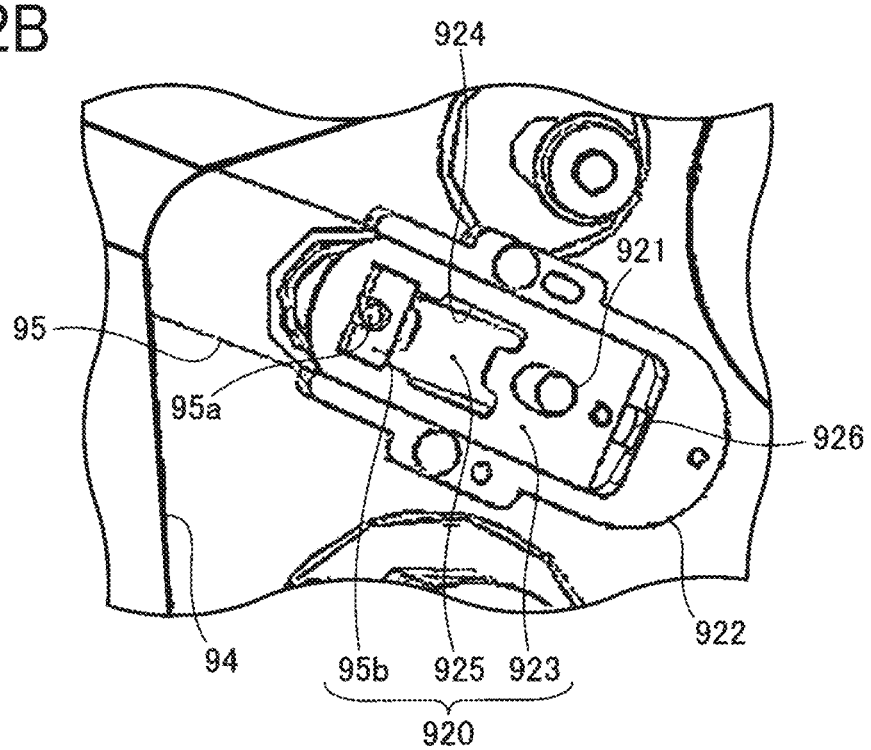
FIG. 2B is a perspective view of a pressing mechanism disposed in the first unit of FIG. 2A.

FIG. 2A is a perspective view of a first unit including the fixing belt 94 and rollers supporting the fixing belt 94. FIG. 2B is a perspective view of a pressing mechanism disposed in the first unit of FIG. 2A. With reference to FIGS. 2A and 2B, the first unit and the pressing mechanism are described below. The first unit 910 includes a front frame 911 and a back frame 912. The front frame 911 and the back frame 912 rotatably support the heating roller 91, the fixing roller 93, and the support roller 96 at predetermined positions. The front frame 911 includes a receiving portion 913 for the heating roller 91 and a receiving portion 914 for the fixing roller 93 on the front surface of the front frame 911. The receiving portions 913 and 914 serve as attachment portions to a fixing device frame described below. The front frame 911 has a through hole 915, and a tip end portion of a positioning rod 921 integrated with a pressing mechanism of the tension roller 95 protrudes through the through hole 915.

FIG. 2B is the perspective view of the pressing mechanism 920 disposed backside of the front frame 911. The pressing mechanism 920 illustrated in FIG. 2B presses a front portion of the tension roller 95. The pressing mechanism 920 includes a guide 922 fixed on the backside of the front frame 911 and a tension bracket 923 guided by the guide 922 so as to be movable forward and backward in a tension direction in which the tension roller 95 is pressed. The tension bracket 923 includes a slider 95*b* that holds the shaft 95*a* of the tension roller 95 and a slide window 924 that holds the slider 95*b* so that the slider 95*b* can slide in the tension direction.

The tension bracket 923 includes a tension spring 925 pushing the slider 95*b* in a direction in which the tension roller 95 applies tension to the fixing belt 94, and a positioning rod 921 is fixed on the tension bracket 923. The guide 922 and the tension bracket 923 are coupled to each other by an extension spring 926 as a releasing and biasing member. The extension spring 926 constantly biases the tension bracket 923 to pull the tension bracket 923 in a direction opposite to the tension direction. In other words, the extension spring 926 constantly applies a biasing force that pulls the tension bracket 923 in the direction opposite to the tension direction to the tension bracket 923. The above-described components of the pressing mechanism 920 attached to the front frame 911 are also attached to the back frame 912. The tension brackets 923 on the front frame 911 and the back frame 912 hold the shaft 95*a* of the tension roller 95 and the tension springs 925 included in the pressing mechanism. These components are configured as a second unit.

Figure 3A:
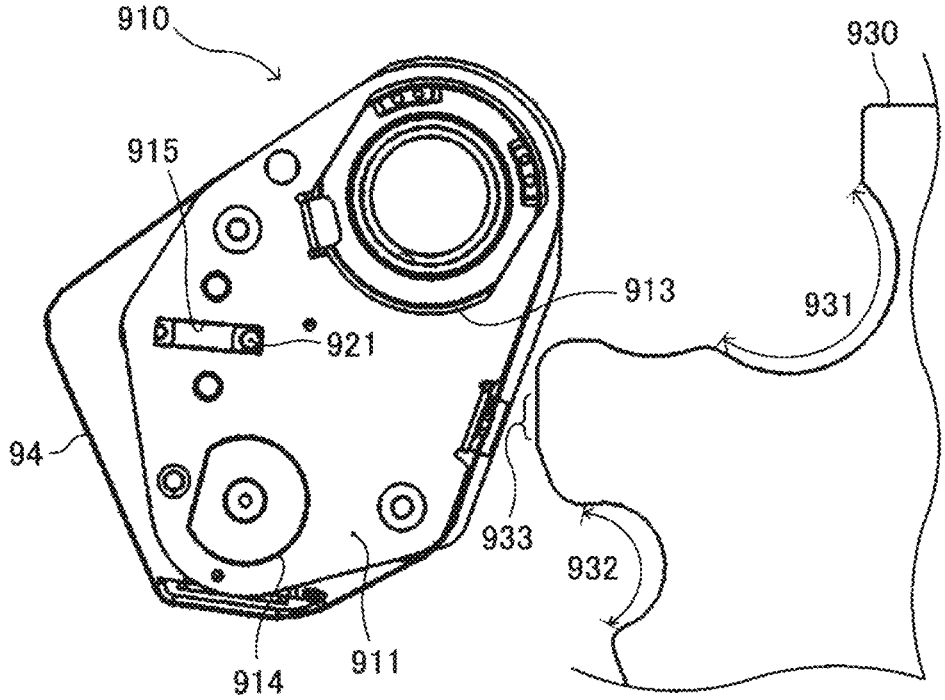
FIG. 3A is an explanatory view of the first unit of FIG. 2A removed from a fixing device main body according to the embodiment of the present disclosure and a frame of a fixing device.
Figure 3B:
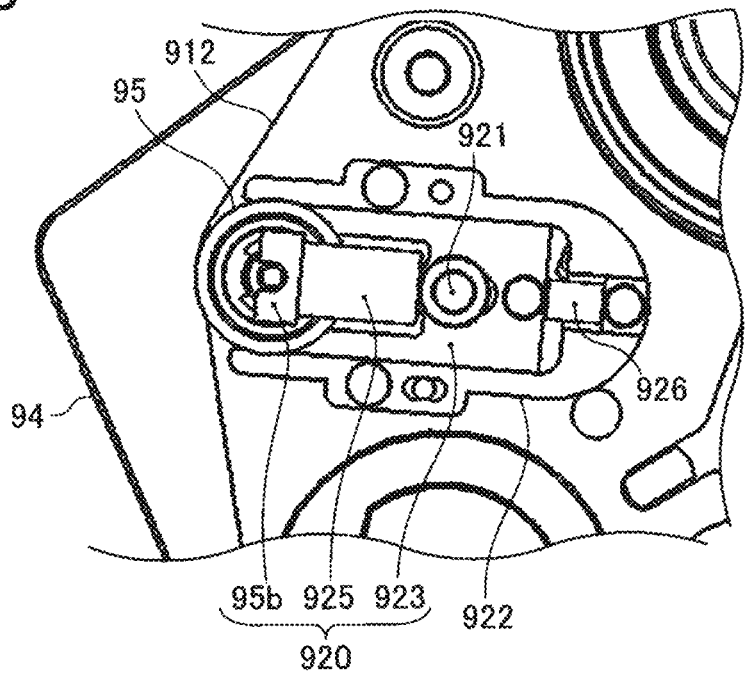
FIG. 3B is an explanatory view of the pressing mechanism in the first unit removed from the fixing device main body illustrated in FIG. 3A.

FIG. 3A is an explanatory view of the first unit 910 removed from a fixing device main body and a front frame 930 of the fixing device. With reference to FIGS. 3A and 3B, the following describes a state of the first unit 910 removed from the fixing device main body. The front frame 930 has frame-side receiving portions 931 and 932 and a positioning portion 933 as a positioner. The frame-side receiving portion 931 receives the receiving portion 913 of the heating roller 91, and the frame-side receiving portion 932 receives the receiving portion 914 of the fixing roller 93. The positioning rod 921 butts against the positioning portion 933. The same applies to the back side of the first unit 910. FIG. 3B is an enlarged explanatory view of the pressing mechanism 920 in the first unit 910 removed from the fixing device main body. The extension spring 926 pulls the tension bracket 923, and the tension spring 925 maintains its natural length. As a result, the tension roller 95 is at a retracted position in which the tension roller 95 is retracted in a direction opposite to the tension direction in which the tension roller 95 applies tension to the fixing belt 94.

Figure 4A:
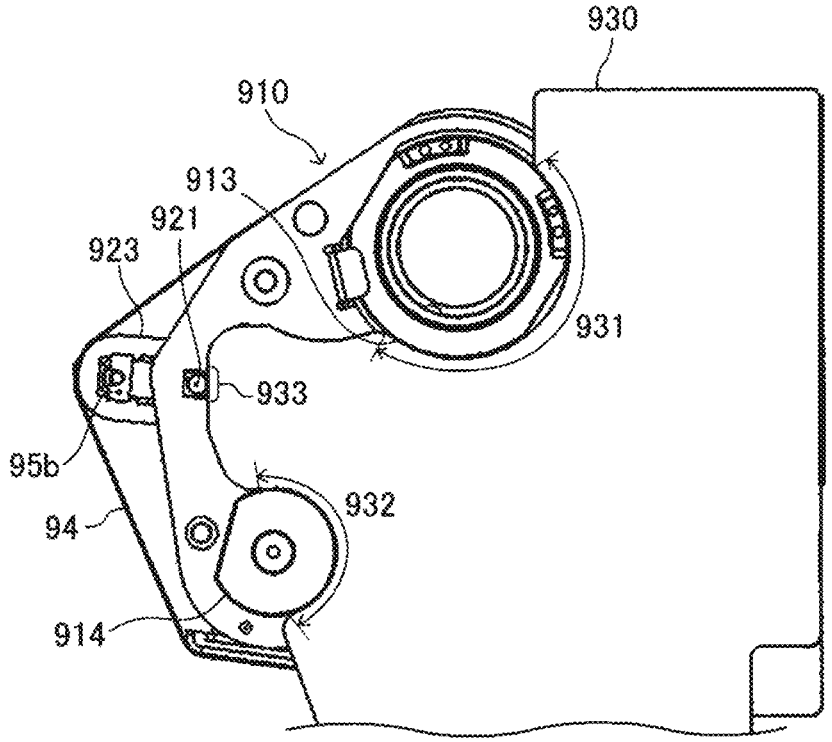
FIG. 4A is an explanatory view of the first unit attached to the fixing device main body of FIG. 3A.
Figure 4B:
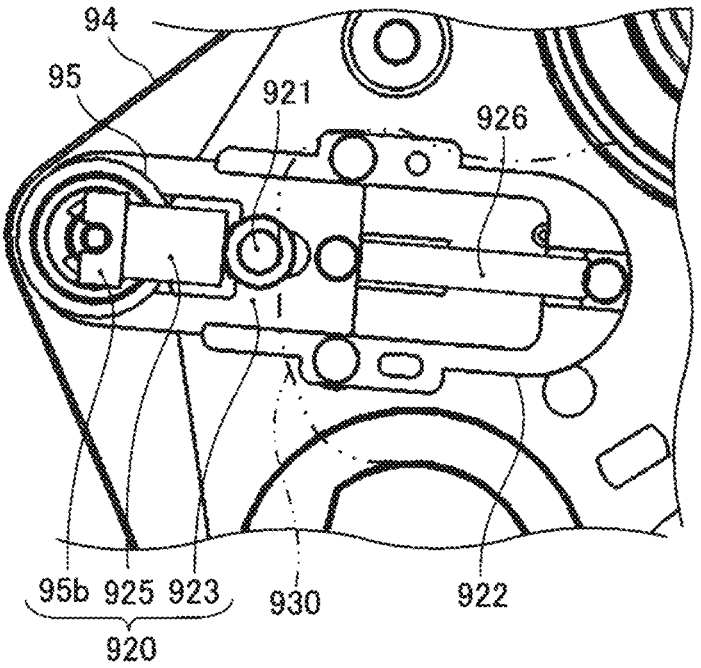
FIG. 4B is an explanatory view of the pressing mechanism in the first unit attached to the fixing device main body of FIG. 4A.

FIG. 4A is an explanatory view of the first unit 910 attached to the fixing device main body, and FIG. 4B is an explanatory view of the pressing mechanism in the first unit 910 attached to the fixing device main body. With reference to FIGS. 4A and 4B, the following describes a configuration of the first unit 910 attached to the fixing device main body. As illustrated in FIG. 4A, the frame-side receiving portion 931 receives the receiving portion 913 of the heating roller 91, the frame-side receiving portion 932 receives the receiving portion 914 of the fixing roller 93, and the positioning portion 933 receives the positioning rod 921. As illustrated in FIG. 4*b*, the extension spring 926 is stretched, and the tension spring 925 is compressed. As a result, the tension roller 95 is biased in the tension direction, and the tension roller 95 takes an operating position.

Figure 5A:
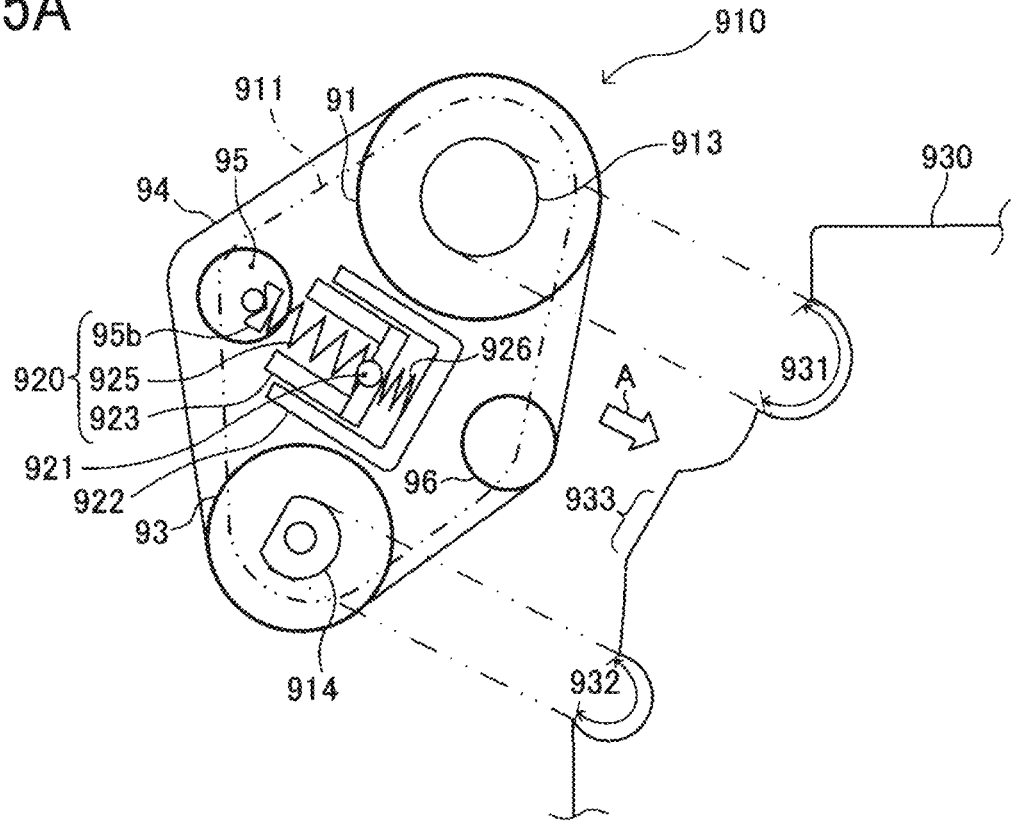
FIGS. 5A and 5B are explanatory views illustrating changes in springs in the first unit when the first unit removed from the fixing device main body as illustrated in FIGS. 3A and 3B is attached to the fixing device main body.
Figure 5B:
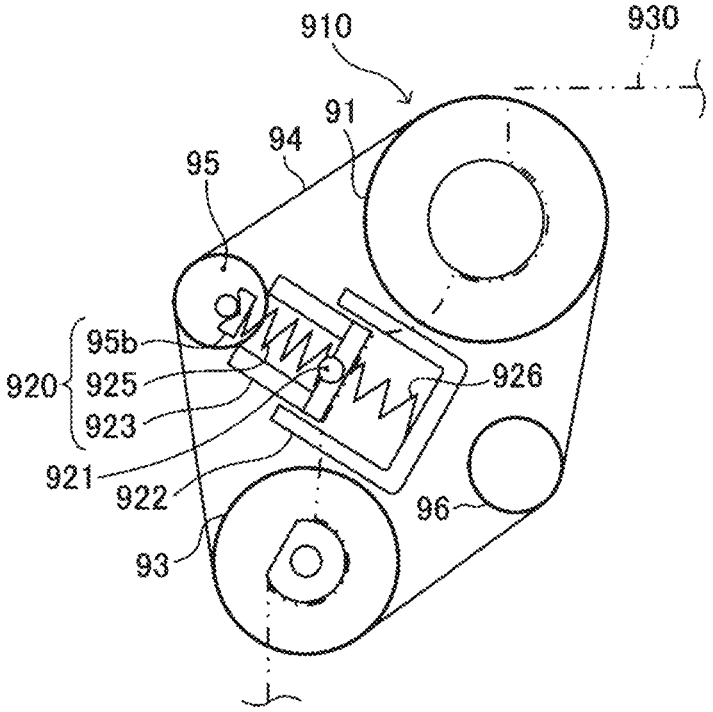

FIGS. 5A and 5B are explanatory views illustrating changes in the tension spring 925 and the extension spring 926 in the first unit 910 when the first unit removed from the fixing device main body is attached to the fixing device main body. As illustrated in FIG. 5A, the tension spring 926 has the natural length when the first unit 910 is not set in the fixing device main body, and the tension bracket 923 is at its original position. When the first unit 910 is moved toward the fixing device in a direction indicated by arrow A of FIG. 5A and attached to the fixing device, the positioning rod 921 butts against the positioning portion 933 of the front frame 930 of the fixing device main body as illustrated in FIG. 5B to be fixed at a set position. At this time, the force of the tension spring 925 acts on the tension roller 95, but the force of the extension spring 926 does not act on the tension roller 95.

As described above, the fixing device according to the present embodiment includes the first unit and the second unit. The first unit includes the plurality of rollers including at least one tension roller and the rotatable fixing belt which is stretched between the rollers. The second unit includes the tension roller and the pressing mechanism for pressing the tension roller against the fixing belt. Removing the first unit from the fixing device main body releases positioning the second unit and reduce the tension of the fixing belt. In addition, the configuration in which the spring in the first unit pulls the second unit smoothly retracts the second unit and reduces the tension of the fixing belt when the fixing unit is removed. The belt device such as the fixing device according to the above-described embodiment simplify a belt tension applying mechanism. Removing the belt unit from a belt device main body automatically releases positioning, and the spring retracts the belt tension applying mechanism inside the belt unit. Such a configuration enables exchanging the belt without removing the belt tension applying mechanism from the belt unit.

Since at least one of both side plates of the first unit 910 is smaller than the inner periphery of the fixing belt 94 to which the tension is not applied as illustrated in FIG. 3A, the belt can be pulled out without removing a component after the tension is released. In order to remove the belt, the tension does not need to set to zero. Setting the tension weaker than the tension in the operating state enables removing the belt. In particular, since the balance between the friction between the roller and the belt and the force for pulling out the belt affects removing the belt that does not have skew prevention guides such as skew prevention rubber guides disposed on both ends of the belt, weakening the tension enables removing belt even if the tension is not completely released. Changing the amount of retraction of the tension roller 95 enables reducing the tension.

Figure 6A:
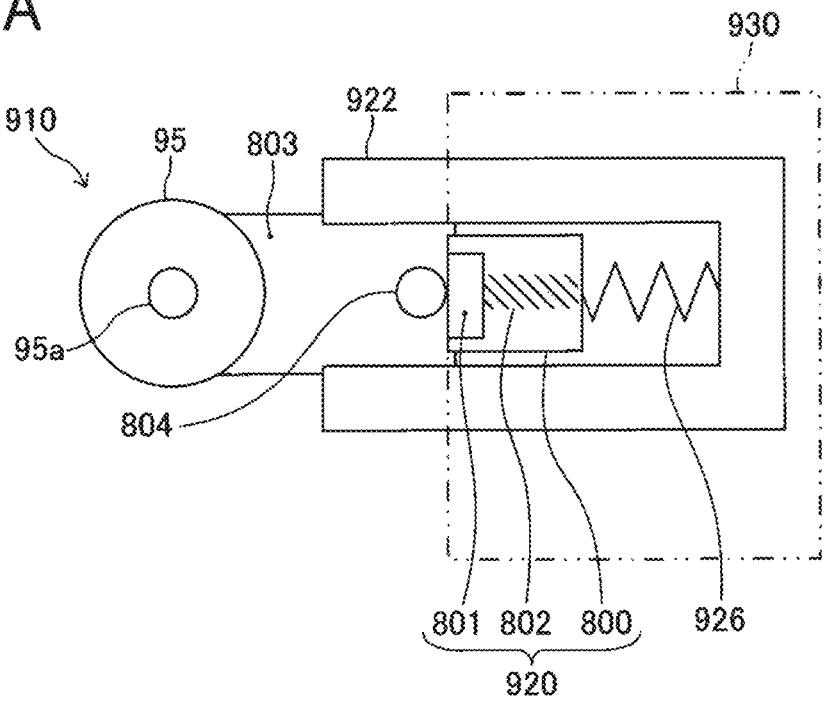
FIGS. 6A and 6B are explanatory views of a first variation of the embodiment of the present disclosure.
Figure 6B:
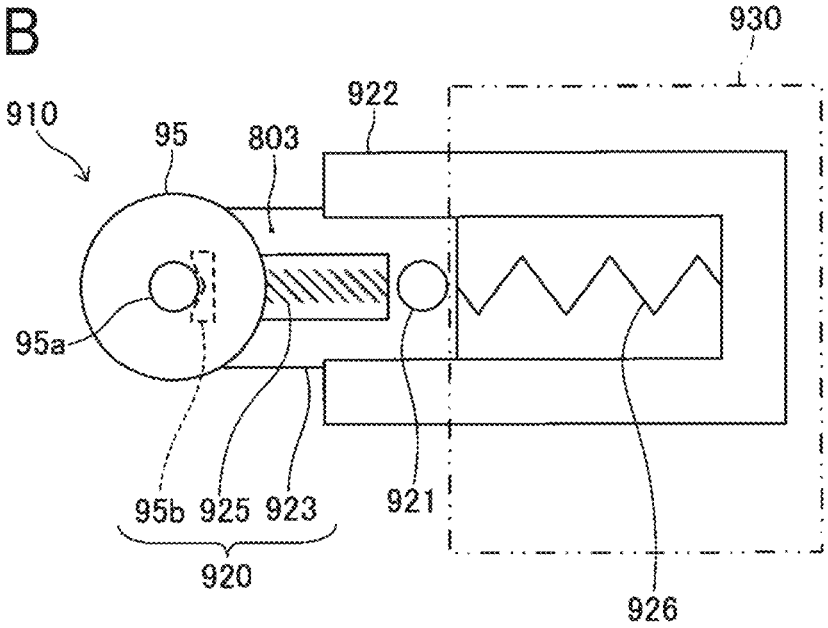

The pressing mechanism 920 in the above-described embodiment is disposed on the tension bracket 923 included in the second unit. However, instead of the tension bracket 923, the pressing mechanism 920 may be disposed on, for example, the front frame 930 of the fixing device main body. FIG. 6A is an explanatory schematic view of a first variation, and FIG. 6B is an explanatory schematic view of a corresponding portion of the above-described embodiment. As illustrated in FIG. 6A, a spring housing case 800 is fixed to the front frame 930, and a slider 801 and a tension spring 802 for pushing out the slider 801 are housed in the spring housing case to form a pressing mechanism 920.

In the first unit 910, the guide 922 guides the bracket 803 movably in the tension direction, the bracket 803 rotatably holds the shaft 95*a* of the tension roller 95, and a pressing rod 804 is fixed on the bracket 803. The slider 801 of the pressing mechanism 920 butts against the pressing rod 804. According to the first variation, disposing the pressing mechanism 920 on the fixing device main body improves the strength of the fixing device, and the structure of a movable portion that is the second unit can be simplified because the movable portion does not include the pressing mechanism.

Figure 7A:
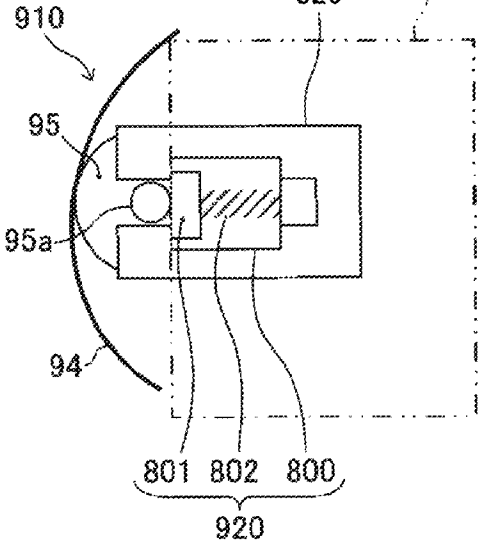
FIGS. 7A to 7D are explanatory views of a second variation of the embodiment of the present disclosure.
Figure 7B:
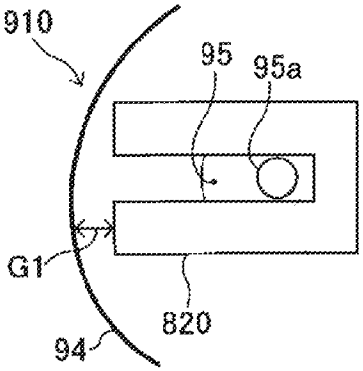
Figure 7C:
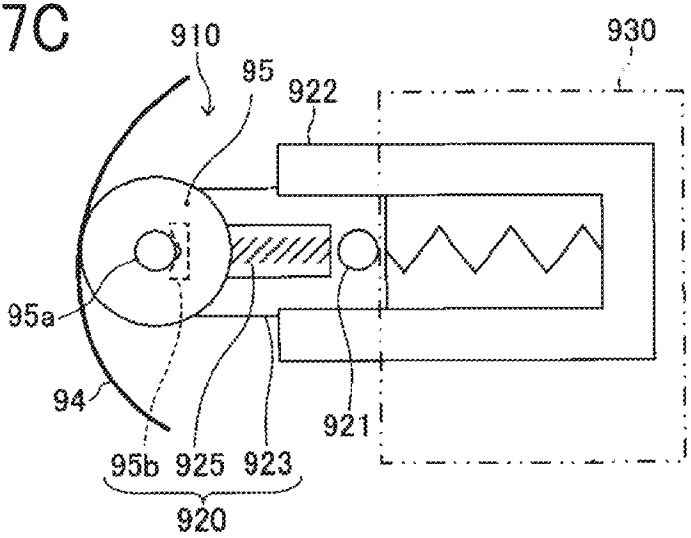
Figure 7D:
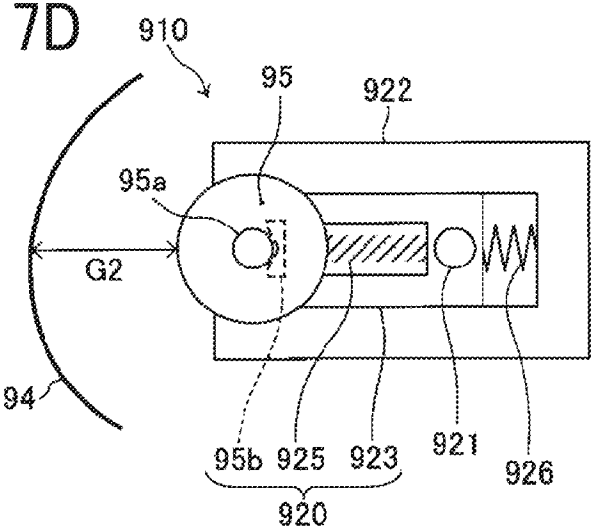

FIG. 7A is an explanatory schematic view of a second variation of the embodiment of the present disclosure. FIG. 7A illustrates a part of the fixing device including the first unit 910 according to the second variation taken out from the fixing device main body. FIGS. 7C and 7D are explanatory schematic views of the part of the fixing device according to the above-described embodiment, that is, the part corresponding to the part of FIG. 7A, which enable comparison between the embodiment and the second variation. In the second variation, the pressing mechanism 920 includes the spring housing case 800, the slider 801, and the tension spring 802 and is disposed on the fixing device main body similar to the first variation illustrated in FIG. 6A. In addition, the configuration of the second unit as the movable portion is further simplified.

Specifically, the shaft 95*a* of the tension roller 95 moves in guide grooves of the rails 820 disposed in the first unit 910. The slider 801 of the pressing mechanism 920 disposed on the fixing device main body presses the shaft 95*a* of the tension roller 95 to apply the tension to the fixing belt 94. As illustrated in FIG. 7B, it is preferable to add a spring for pulling the shaft 95*a* of the tension roller 95 to the right side in FIG. 7B so that the tension roller 95 separates from the fixing belt 94 when the first unit 910 is taken out from the fixing device main body.

As illustrated in FIG. 7B, a gap G1 is formed between the inner surface of the fixing belt 94 and the tip of the rail 820 when the first unit 910 is removed from the fixing device main body. Moving the tension roller 95 as described in the second variation needs positioning the tip of the rail 820 to be very close to the fixing belt 94 rotating during a fixing operation. As a result, even if the tension roller 95 is retracted, the tip of the rail 820 prevents securely setting a sufficiently wide gap G1. In order to securely set the sufficiently wide gap G1, a mechanism may be disposed to move the rail 820, but the mechanism becomes complicated. In this regard, the above-described embodiment as illustrated in FIG. 7D can securely set the gap G2 between the tension roller 95 and the inner surface of the fixing belt 94 relatively wider than the second variation. Accordingly, the above-described embodiment is advantageous in terms of securing the "space between the belt and the pressing mechanism" for removing the fixing belt 94.

The above-described embodiments are illustrative and do not limit this disclosure. Thus, numerous additional modifications and variations are possible in light of the above teachings. For example, elements and/or features of different illustrative embodiments may be combined with each other and/or substituted for each other within the scope of this disclosure.

For example, the image forming apparatus is not be limited to the printer and may be, for example, a copier, a stand-alone fax machine, or a multifunction peripheral including at least two functions of a copier, a printer, a fax machine, and a scanner. The belt device of the present disclosure is not limited to the fixing belt device, may be applied to various belt devices.

The effects obtained by the above-described embodiment and variations are examples. The effects according to the present disclosure are not limited to the above-described effects.

What is claimed is:

1. A belt device comprising:
a belt device main body including a positioner;
a first unit including:
a belt;
a support to support the belt; and
a releasing and biasing member,
the first unit configured to be detachably attached to the belt device main body; and
a second unit including a tensioner abutting the belt,
the second unit configured to be positioned at an operating position at which a tension spring causes the tensioner to apply tension to the belt when the first unit is attached to the belt device main body and positioned at a releasing position at which the tensioner is configured to release the tension applied to the belt when the first unit is detached from the belt device main body,
wherein the releasing and biasing member is configured to bias the second unit to the releasing position, and
wherein the positioner is configured to
position the second unit at the operating position when the first unit is attached to the belt device main body and release positioning of the second unit at the operating position when the first unit is detached from the belt device main body, and
position the second unit at the operating position against a biasing force of the releasing and biasing member.

2. The belt device according to claim 1, further comprising
a pressing mechanism configured to press the tensioner against the belt.

3. The belt device according to claim 2,
wherein the second unit includes the pressing mechanism.

4. The belt device of claim 2, wherein the pressing mechanism comprises:
a guide; and
a tension bracket.

5. The belt device of claim 4, wherein the tension bracket comprises:
a slider configured to hold a shaft of the tensioner;
a slide window configured to hold the slider; and
the tension spring configured to push the slider to cause the tensioner to apply tension to the belt.

6. The belt device of claim 5, wherein the tension bracket further comprises an extension spring configured to constantly bias the tension bracket.

7. The belt device according to claim 1,
wherein the first unit includes side plates on both sides of the first unit, and at least one of the side plates is smaller than an inner periphery of the belt to which the tension is not applied.

8. A fixing device comprising:
a heating rotator;
a pressing rotator; and
the belt device according to claim 1.

9. An image forming apparatus comprising
the fixing device according to claim 8.

10. The belt device of claim 1, wherein the second unit is attached to the first unit.

11. The belt device of claim 10, wherein the second unit is configured to remain attached to the first unit when the first unit is detached from the belt device main body.

12. The belt device of claim 1, wherein the first unit further comprises a positioning rod.

13. The belt device of claim 12, wherein the positioning rod is configured to stretch an extension spring and compress the tension spring.

14. The belt device of claim 12, wherein the belt device main body includes a positioning portion configured to cause the positioning rod to stretch an extension spring and compress the tension spring in response to the positioning rod butting against the positioning portion.

15. The belt device of claim 12, wherein the belt device main body includes a positioning portion configured to cause the positioning rod to stretch an extension spring and compress the tension spring in response to the positioning rod butting against the positioning portion.

16. The belt device of claim 12, wherein the positioning rod is configured to butt against a positioning portion of the belt device main body when the first unit is attached to the belt device main body.

17. The belt device of claim 12, wherein the positioning rod is configured to compress the tension spring towards the tensioner by the positioning rod moving towards the tensioner.

18. The belt device of claim 1, wherein a shaft of the tensioner is configured to move in guided grooves of rails.

19. The belt device of claim 18 wherein the rails are configured to form a gap between an inner surface of the belt and a tip of the rails at the releasing position.

20. A belt device comprising:
a belt device main body;
a first unit including:
a belt; and a support to support the belt, the first unit configured to be detachably attached to the belt device main body;

a second unit including a tensioner abutting the belt, the second unit configured to be positioned at an operating position at which a tension spring causes the tensioner to apply tension to the belt when the first unit is attached to the belt device main body and positioned at a releasing position at which the tensioner is configured to release the tension applied to the belt when the first unit is detached from the belt device main body; and a pressing mechanism configured to press the tensioner against the belt, the pressing mechanism including:

a guide; and a tension bracket including a slider configured to hold a shaft of the tensioner;

a slide window configured to hold the slider; and the tension spring configured to push the slider to cause the tensioner to apply tension to the belt.

* * * * *